United States Patent [19]

Scott-King

[11] 4,062,514

[45] Dec. 13, 1977

[54] SHUTTERING PANEL SYSTEM

[75] Inventor: Lyonel Scott-King, Durban, South Africa

[73] Assignee: Christopher John Scott-King, Houghton, South Africa

[21] Appl. No.: 687,389

[22] Filed: May 17, 1976

[30] Foreign Application Priority Data

May 20, 1975 South Africa ..... 75/3242
May 26, 1975 South Africa ..... 75/3357

[51] Int. Cl.[2] ..... E04G 9/00; E04G 11/06; E04G 17/06

[52] U.S. Cl. ..... 249/41; 249/45; 249/191; 249/192; 249/214

[58] Field of Search ..... 249/1, 40, 41, 44, 45, 249/47, 192, 214, 46, 190, 191, 196

[56] References Cited

U.S. PATENT DOCUMENTS

| | | | |
|---|---|---|---|
| 1,556,313 | 10/1925 | Dodd | 249/44 |
| 1,616,354 | 2/1927 | Comer | 249/47 X |
| 3,055,076 | 9/1962 | Van Helden | 249/45 |
| 3,469,815 | 9/1969 | Brenneman | 249/214 X |
| 3,788,591 | 1/1974 | Arps | 249/157 X |
| 3,863,886 | 2/1975 | Carr | 249/192 |

*Primary Examiner*—Francis S. Husar
*Assistant Examiner*—John S. Brown

[57] ABSTRACT

The invention relates to a shuttering system which has a series of connector or distance elements, the elements having formations which receive complemental formations in the shuttering panels, the portions outside of the formations being capable of being broken off or removed when the shuttering panels are removed, leaving the remainder of the element in the wall.

2 Claims, 10 Drawing Figures

Fig. 6
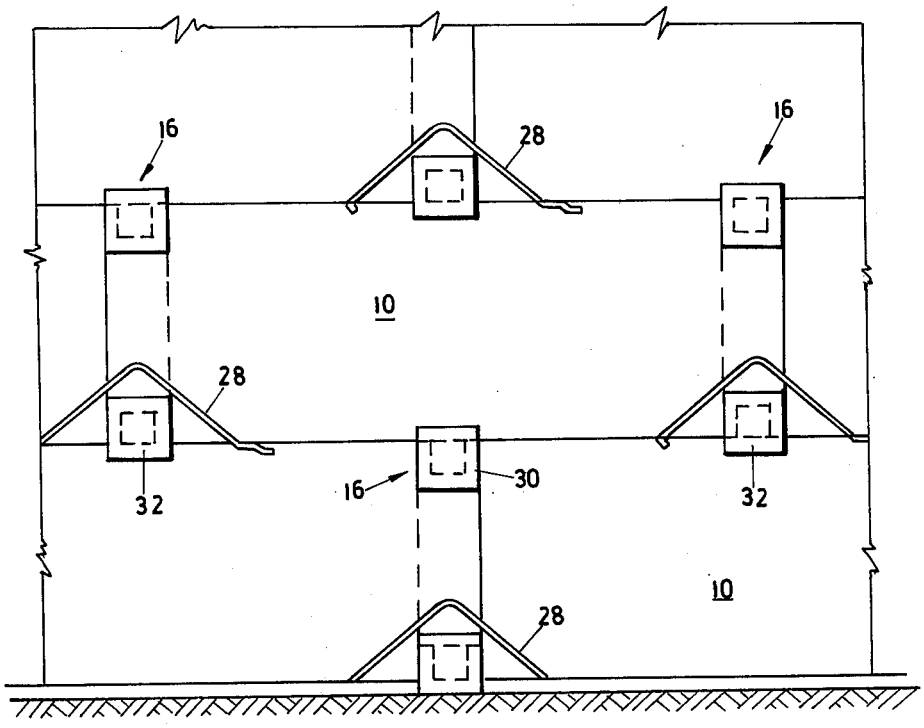
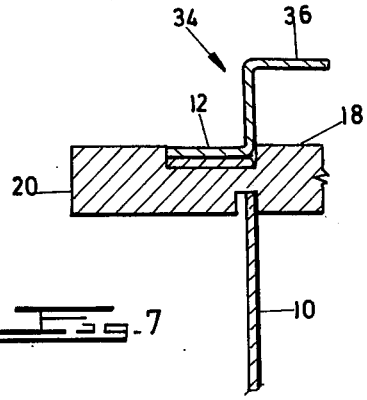
Fig. 7
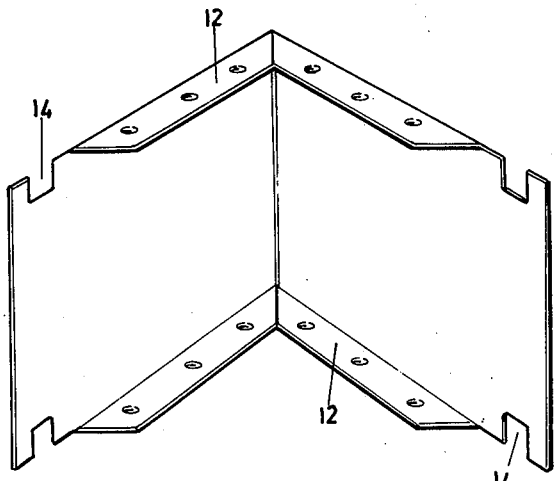
Fig. 8

SHUTTERING PANEL SYSTEM

This invention relates to shuttering and it is an object of the invention to provide a very simple and inexpensive shuttering arrangement which leads to the rapid erection of walls, columns or the like.

According to the invention shuttering includes a series of connector/distance elements have formations adapted to receive substantially complemental formations in shuttering panels, and which include portions or elements adapted to be on the outside of the panels in use and which may be easily broken or removed to free the panels once they have served their purpose.

The connections may be made of a variety of materials, the prerequisite being that they are capable of withstanding the expansive force applied and that they are easily broken at least along a weakened line or zone. Wood is a convenient material, but concrete, ceramic, certain plastic materials, compressed paper and the like may also be used successfully.

An embodiment of the invention is now described by way of example with reference to the drawings in which:

FIG. 6 is a fragmentary side elevation of an assembled wall of the shuttering, FIG. 7 is a sectional side elevation of the upper edge of a wall of the shuttering, and FIG. 8 is a standard panel bent to accommodate a corner or T-wall.

Figure 1:
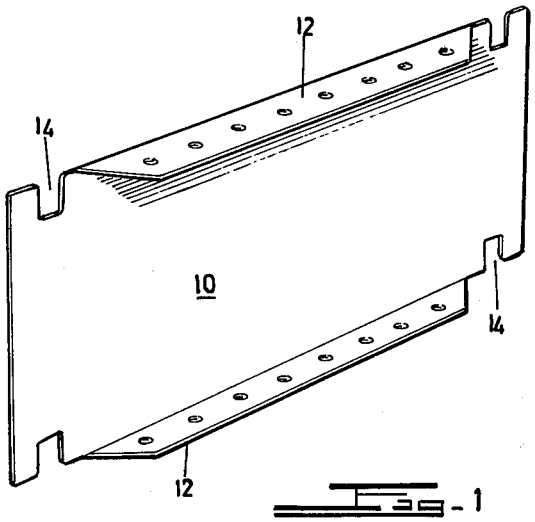
FIG. 1 is a perspective view of a shutter panel of the invention.

The panels 10 of the shuttering, as illustrated in FIG. 1, are made from galvanised mild steel sheet or other suitable material and include, on opposed longitudinal sides, holed flanges 12 which stop short of the ends of the panel and slots 14 located in the edges of the panels, which carry the flanges, midway between the ends of the flanges and panel. The panels may include stiffening ribs, not shown.

Figure 2:
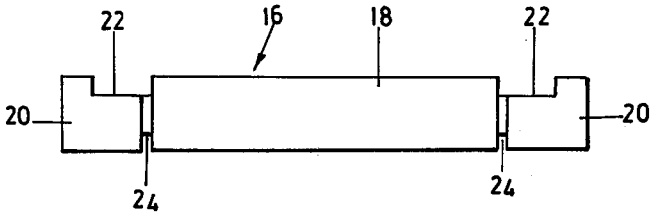
FIGS. 2 to 4 and 4A and 4B are orthographic views of a connector for joining and spacing the panels of the shuttering.
Figure 3:
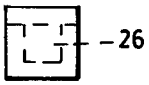
Figure 4:
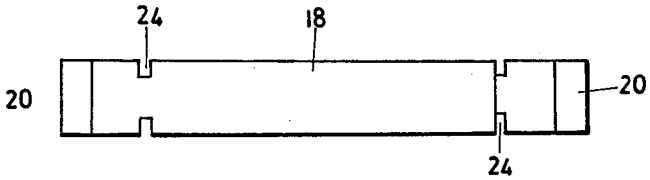

The connector 16 illustrated in FIGS. 2 to 4 is square or other shape in cross-section, and is made from wood but may be made from any cheap, easily fracturable material such as ceramic, and includes a body portion 18 which is separated from ends 20 by rebates 22. The body, at the inner end of the rebate 22, is grooved at 24 on three sides to provide a fracture zone or bridge 26 which, as is seen in FIG. 3, is square in cross-section and concentric with the body 18.

The distance separating the end of each flange on the panels 10 from the end of the panel conforms to the width of a connector 16.

Figure 4A:
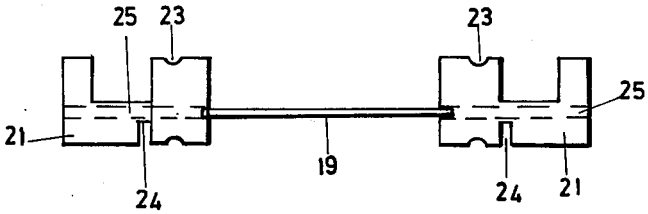

In a further embodiment of the invention as shown in FIG. 4A the body 18 as shown in FIGS. 2 and 4 could be replaced by a strand 19 of rigid wire or other suitable material. The ends 21 could be moulded from a suitable plastics material and may include ends 23 with grooves for keying them into the concrete. The wire 19 may have terminal flats to engage in a chamber in the ends 23 after being inserted right through the ends and turned through an angle to be retracted along a channel formed by grooves 24 which is closed at the inner end as shown. Alternatively the ends of the wire 19 may be fitted with formations adapted to be force-fitted into suitable orifices in the ends 23.

Figure 4B:
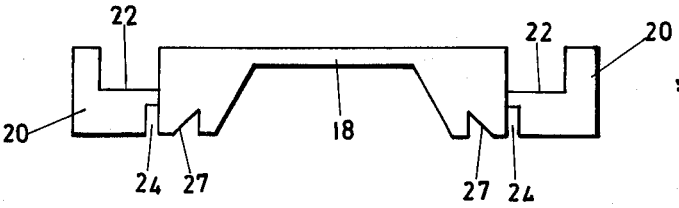

In FIG. 4B the body 18 is of reduced width to save on material and notches 27 are taken from the end pieces.

In use a series of connectors 16 is spaced in a measured parallel relationship on a prepared level foundation or slab and the individual connectors are preferably anchored in position by nails.

Figure 5:
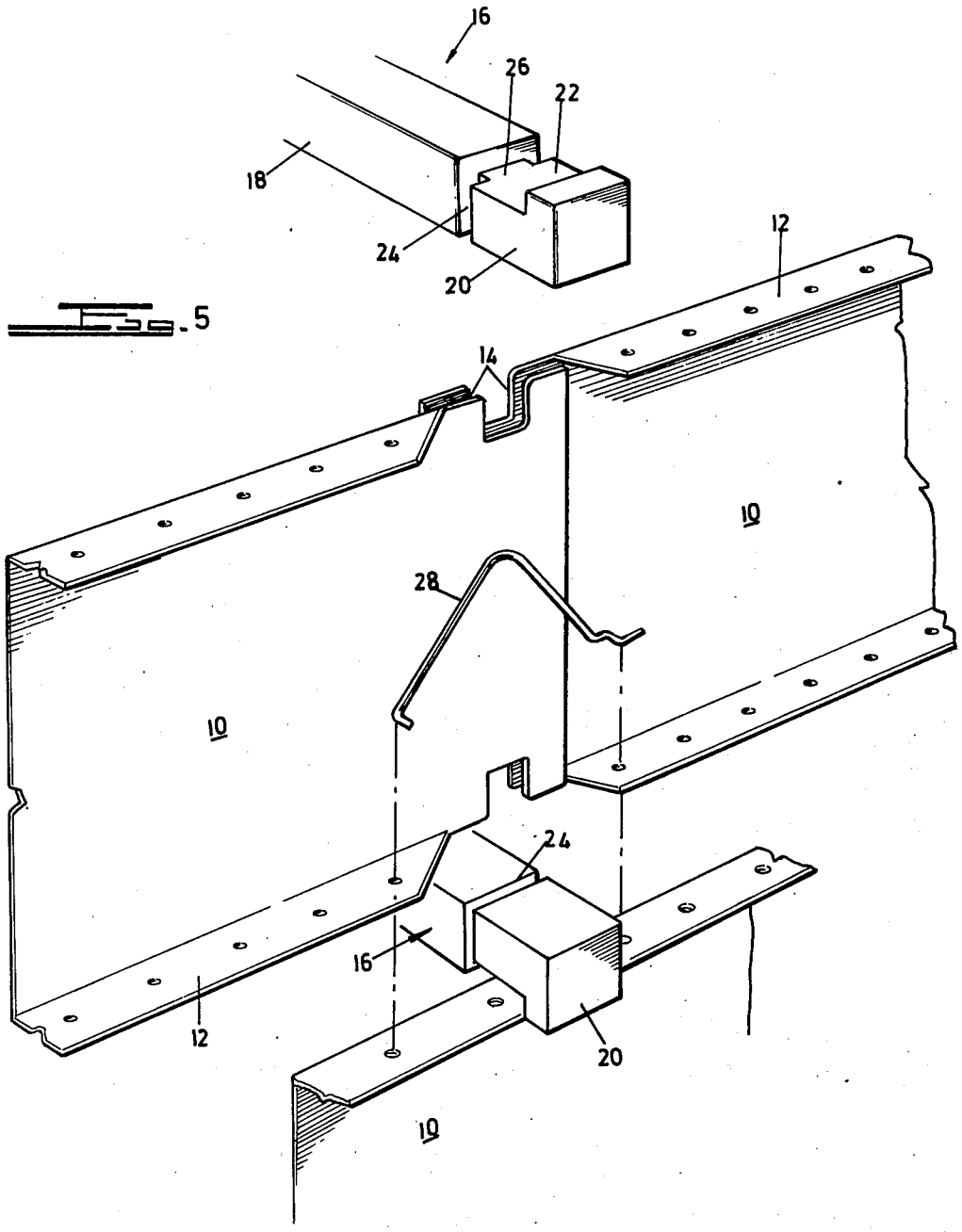
FIG. 5 is an exploded fragmentary perspective view of the shuttering system of the invention.

A series of panels, in which the end of one panel is overlapped with that of another to bring the slots 14 of adjacent panels into register, as seen in FIG. 5, is located with the overlapped slots 14 engaged in the grooves 24 and over the bridges 26 on one side of the aligned foundation connectors. In this position the flanges are directed towards the outside of the wall between the ends 20 of the connectors. The ends of spring steel clips 28, shaped as seen in FIG. 5, are engaged in the holes in the flanges of adjacent panels over the projecting connector ends and along the panels to hold the panels together, to avoid leakage and to provide rigidity.

A second series of panels is located opposite the first on the other end of the aligned connectors in the same manner as described above. The two shutters thus formed are spaced horizontally by a second row of connectors 30 which span the cavity of the wall and are located in the overlapped slots 14 opposite those engaged with the foundation connectors.

The rebates 22 in the second row of connectors are faced upwardly as illustrated in FIG. 5. Additional connectors 32 are then placed across the shutter between those engaged in the upper slots of the bottom row of panels with their rebates 22 facing downwardly over the flanges of the bottom panels.

A further series of panels is then placed vertically over each of those of the bottom rows with their slots 14 engaged with the bridges of the connectors 32 and their flanges abutting those of the bottom row of panels. The flanges of these panels are situated in the rebates of the connectors 30, as seen in FIGS. 5 and 6.

The flanges of the panels 10 of the second vertical rows are joined to each other and the flanges of the bottom row panels by additional clips 28. By repeating this procedure of assembly the shuttering for a wall may be erected to any reasonable height. Parameters such as the size of the panels 10 and the length of the connectors 16 and consequently the spacing of the slots 24 may be varied to suit a desired form of construction. Additionally the connectors may be made to include three or more fracture zones and rebates so that a connector of fixed dimensions may be used for walls of various widths.

When the shuttering for a wall is completed, reinforcing, electrical conduits, water pipes and the like are positioned between the shutters and tied to the connectors 16 which extend between the shutters to keep them in position. The open ends of the shutters are suitably closed and concrete, which preferably has a liquid consistency, is poured between the shutters, agitated and allowed to set.

The above procedure may of course be carried out in successive stages, i.e. the shuttering may be built up to a selected height, the necessary services located between them, the concrete poured and the remaining shuttering erected above this in one or more successive steps. This method of construction will, particularly if the concrete of the separate pours is allowed partially to set, minimise the transverse loads that the lower shutter panels would otherwise be subject to and thinner gauge material may be used in the construction of the panels.

If the above progressive method of construction is used in the building of a wall provision must be made for the location of connectors on the upper edge of the partially erected shuttering for the remaining panels. This may be achieved by using a topping strip 34 as illustrated in FIG. 7.

The lower edge of the strip 34 is identical to the lower edge of a panel 10 and includes a flange 12, slots 14, not shown, and an inwardly directed flange 36.

Concrete of each successive pour is levelled just below the flange 36.

The topping strip serves two purposes; the first is to locate the upper connectors and the second is to ensure that the interface between the upper and lower concrete pour does not lie on a line of horizontal weakness in the wall caused by a series of connectors.

When the concrete of the wall has set, the projecting ends 20 of the connectors are sheared from the bodies of the connectors in the fracture zone 26, which lie substantially flush with the surface of the wall, by the tap of a hammer or other suitable tool. The shuttering is dismantled merely by unclipping the clips 28. The wall is then clad in any suitable manner.

Corners or T's may be made in the wall and the columns constructed by using L-shaped panels substantially as illustrated in FIG. 8. These may be made to any desired angle and may even be curved.

The invention is not limited to the precise constructional detail as set out above and large diameter hollow tubes could be located between the shutters to carry services such as the electrical conduits and boards, water pipes etc. and even conditioned air. Additionally inserts such as doors, windows, air bricks and the like could be contained by the shuttering.

What I claim is:

1. A shuttering system comprising a combination of a series of elements of easily-fracturable material and shuttering panels, the elements having end formations with vertical grooves, said shuttering panels having slots along the horizontal edges thereof and spaced inwardly from the vertical edges thereof, the slots of horizontally overlapped adjacent panels being aligned and engaging said vertical grooves, said grooves being a predetermined distance apart and constituting a zone of easy fracturability; and rebates adjacent the grooves receiving horizontal flanges of the shuttering panels located immediately therebelow.

2. A shuttering system as claimed in claim 1 wherein said horizontal flanges of the shuttering panels have spaced orifices therealong, and spring slip means engaging orifices of horizontally and vertically adjacent panels to secure said panels to one another.

* * * * *